US008814160B2

(12) United States Patent
Chen

(10) Patent No.: US 8,814,160 B2
(45) Date of Patent: Aug. 26, 2014

(54) DE-SKEWING MECHANISM FOR DE-SKEWING A PRINTING MEDIUM AND THERMAL SUBLIMATION PRINTER THEREWITH

(75) Inventor: Chien-Ju Chen, Keelung (TW)

(73) Assignee: HiTi Digital, Inc., Xindian Dist., New Taipei (TW)

( * ) Notice: Subject to any disclaimer, the term of this patent is extended or adjusted under 35 U.S.C. 154(b) by 0 days.

(21) Appl. No.: 13/610,914

(22) Filed: Sep. 12, 2012

(65) Prior Publication Data

US 2013/0162747 A1 Jun. 27, 2013

(30) Foreign Application Priority Data

Dec. 22, 2011 (TW) ..... 100148075 A

(51) Int. Cl.
*B65H 23/18* (2006.01)

(52) U.S. Cl.
USPC ..... 271/226; 271/228; 226/29; 226/37

(58) Field of Classification Search
USPC ..... 271/242, 226, 228; 226/29, 34, 37, 144, 226/178; 347/218, 219
See application file for complete search history.

(56) References Cited

U.S. PATENT DOCUMENTS

| | | | | |
|---|---|---|---|---|
| 5,240,241 | A * | 8/1993 | Kawazoe | 271/114 |
| 6,578,844 | B2 * | 6/2003 | Acquaviva et al. | 271/228 |
| 7,441,763 | B2 | 10/2008 | Su | |
| 7,484,723 | B2 * | 2/2009 | Kuo et al. | 271/10.09 |
| 2009/0096155 | A1 * | 4/2009 | Deckard | 271/228 |
| 2009/0102117 | A1 * | 4/2009 | Yu et al. | 271/226 |

* cited by examiner

*Primary Examiner* — Jeremy R Severson
(74) *Attorney, Agent, or Firm* — Winston Hsu; Scott Margo

(57) ABSTRACT

A de-skewing mechanism for de-skewing a printing medium is disclosed. The printing medium is conveyed by a conveying mechanism in a first linear velocity. The de-skewing mechanism includes a first calibrating roller, a second calibrating roller and a first torque limiting member. The first calibration roller is utilized for conveying a first side of the printing medium in a second linear velocity greater than the first linear velocity, and the second calibrating roller is utilized for conveying a second side of the printing medium in the second linear velocity. The first torque limiting member is coupled to the first calibrating roller and is utilized for stopping driving the first calibrating roller when the first side of the printing medium reaches a predetermined tension, such that the second side of the printing medium is capable of proceeding relative to the first side, so as to be aligned with the first side.

12 Claims, 7 Drawing Sheets

DE-SKEWING MECHANISM FOR DE-SKEWING A PRINTING MEDIUM AND THERMAL SUBLIMATION PRINTER THEREWITH

BACKGROUND OF THE INVENTION

1. Field of the Invention

The present invention relates to a de-skewing mechanism and a thermal sublimation printer therewith, and more particularly, to a de-skewing mechanism for de-skewing a printing medium and a thermal sublimation printer therewith.

2. Description of the Prior Art

Generally speaking, a conventional thermal sublimation printer utilizes a conveying mechanism to convey a printing medium of a paper roll to a thermal print head module, so as to transfer an image onto the printing medium by thermal printing. However, when two sides of a front edge of the printing medium are not aligned with each other during the thermal printing process, that is, when the front edge of the printing medium skews relative to a direction in which the conveying mechanism conveys the printing medium, the image on the printing medium transferred by the thermal print head module skews relative to the printing medium accordingly. The aforesaid issue of skew causes that the image cannot be transferred on to the printing medium appropriately, i.e. the image can not be transferred to a margin of the printing medium appropriately, resulting in a blank or an incomplete image on the margin of the printing medium. As a result, it reduces quality of printed images and advantages of products in the market.

SUMMARY OF THE INVENTION

The present invention provides a de-skewing mechanism for de-skewing a printing medium and a thermal sublimation printer therewith for solving above drawbacks.

According to the claimed invention, a de-skewing mechanism for de-skewing a printing medium is disclosed. The printing medium is conveyed by a conveying mechanism in a first linear velocity. The de-skewing mechanism includes a first calibrating roller, a second calibrating roller and a first torque limiting member. The first calibrating roller is for conveying a first side of the printing medium in a second linear velocity greater than the first linear velocity. The second calibrating roller is for conveying a second side of the printing medium in the second linear velocity. The first torque limiting member is coupled to the first calibrating roller for stopping driving the first calibrating roller when the first side of the printing medium reaches a predetermined tension, such that the second side of the printing medium is capable of proceeding relative to the first side, so as to be aligned with the first side.

According to the claimed invention, the de-skewing mechanism further includes a second torque limiting member coupled to the second calibrating roller for stopping driving the second calibrating roller when the second side of the printing medium reaches the predetermined tension, such that the first side of the printing medium is capable of proceeding relative to the second side, so as to be aligned with the second side.

According to the claimed invention, the de-skewing mechanism further includes an actuator, a transmission shaft and a gear transmission assembly. The transmission shaft is for transmitting a torque to the first torque limiting member and the second torque limiting member. The gear transmission assembly is engaged with the actuator and the transmission shaft for transmitting the torque generated by the actuator to the transmission shaft.

According to the claimed invention, the de-skewing mechanism further includes a first idle roller and a second idle roller. The first idle roller is for conveying the first side of the printing medium cooperatively with the first calibrating roller. The second idle roller is for conveying the second side of the printing medium cooperatively with the second calibrating roller.

According to the claimed invention, the de-skewing mechanism further includes a shaft member disposed through the first idle roller and the second idle roller. The first idle roller and the second idle roller are capable of rolling relative to the shaft member, respectively.

According to the claimed invention, the de-skewing mechanism further includes a first cushion and a second cushion. The first cushion is wrapped around a surface of the first calibrating roller, and the second cushion is wrapped around a surface of the second calibrating roller.

According to the claimed invention, the first cushion and the second cushion are respectively made in rubber materials.

According to the claimed invention, a thermal sublimation printer includes a conveying mechanism and a de-skewing mechanism. The conveying mechanism is for conveying a printing medium in a first linear velocity. The de-skewing mechanism is for de-skewing the printing medium. The printing medium is conveyed by the conveying mechanism in a first linear velocity. The de-skewing mechanism includes a first calibrating roller, a second calibrating roller and a first torque limiting member. The first calibrating roller is for conveying a first side of the printing medium in a second linear velocity greater than the first linear velocity. The second calibrating roller is for conveying a second side of the printing medium in the second linear velocity. The first torque limiting member is coupled to the first calibrating roller for stopping driving the first calibrating roller when the first side of the printing medium reaches a predetermined tension, such that the second side of the printing medium is capable of proceeding relative to the first side, so as to be aligned with the first side.

In summary, the present invention utilizes the torque limiting members cooperatively with the calibrating rollers to de-skew the two sides of the printing medium, so as to align the two sides of the printing medium during the thermal printing process. When one of the two sides of the printing medium reaches the predetermined tension, the torque limiting member can not transmit a torque to the calibrating roller, so as to stop driving the calibrating roller. In other words, the side of the printing medium is conveyed by the conveying mechanism and proceeds in the first linear velocity. In the meanwhile, the other side of the printing medium continues to be conveyed by the calibrating roller driven by the torque limiting member. In other words, the other side of the printing medium is conveyed by the calibrating roller and proceeds in the second linear velocity. Since the second linear velocity can be designed to be greater than the first linear velocity, the other side of the printing medium driven by the calibrating roller can proceed relative to the side of the printing medium conveyed by the conveying mechanism at a differential velocity between the first linear velocity and the second linear velocity. In such a manner, the de-skewing mechanism of the present invention can de-skew two sides of a front edge of the printing medium when the printing medium is conveyed, so as to eliminate a blank or an incomplete image on a margin of the printing medium. As a result, it enhances quality of printed images and advantages of products in the market.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
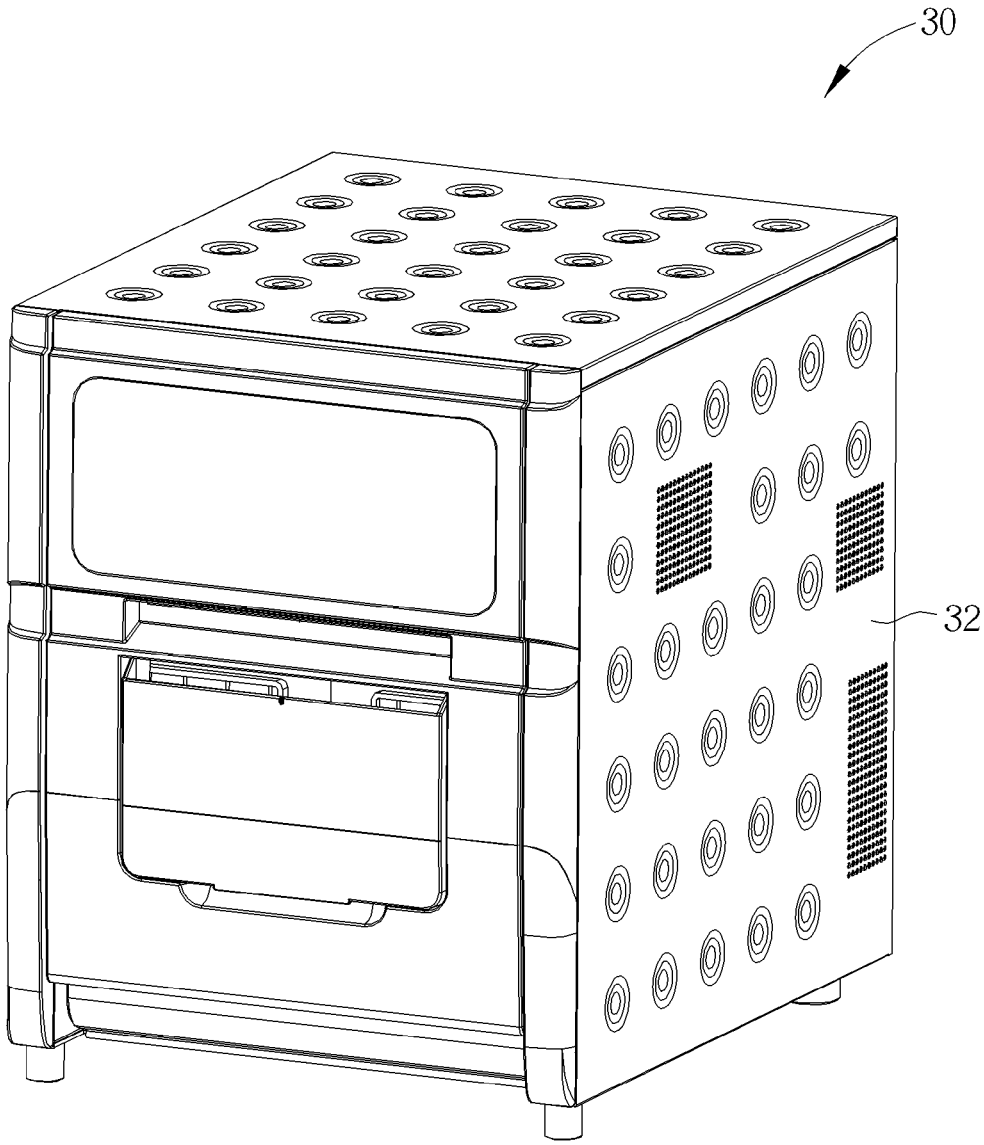
FIG. 1 is a schematic diagram of a thermal sublimation printer according to a preferred embodiment of the present invention.
Figure 2:
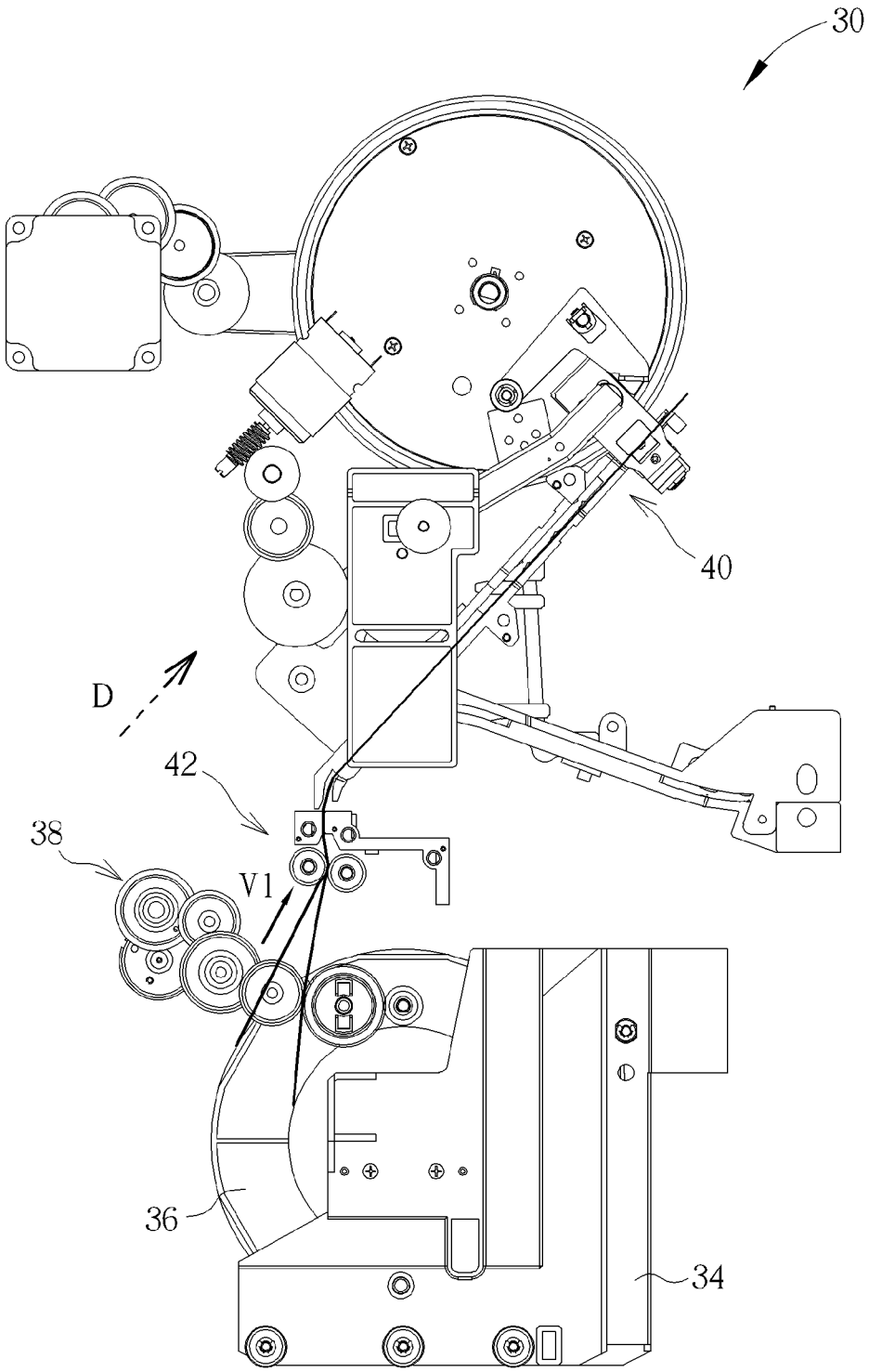
FIG. 2 is an internal diagram of the thermal sublimation printer according to the preferred embodiment of the present invention.

Please refer to FIG. 1 and FIG. 2. FIG. 1 is a schematic diagram of a thermal sublimation printer 30 according to a preferred embodiment of the present invention. FIG. 2 is an internal diagram of the thermal sublimation printer 30 according to the preferred embodiment of the present invention. As shown in FIG. 1 and FIG. 2, the thermal sublimation printer 30 includes a casing 32 and a holding member 34. The holding member 34 is disposed on a bottom of the casing 32 for holding a printing medium 36, such as a paper roll. Furthermore, the thermal sublimation printer 30 further includes a conveying mechanism 38 and a thermal print head module 40. The conveying mechanism 38 is used for conveying the printing medium 36 to the thermal print head module 40 in a first linear velocity V1 acted in a conveying direction D. Accordingly, the thermal print head module 40 can perform following thermal printing process, so as to transfer an image onto the printing medium 36.

Furthermore, the thermal sublimation printer 30 further includes a de-skewing mechanism 42 for de-skewing the printing medium 36 conveyed by the conveying mechanism 38, so as to eliminate skew of a front edge of the printing medium 36 relative to the conveying direction D as the printing medium 36 is conveyed by the conveying mechanism 38. Accordingly, an image transferred onto the printing medium 36 does not skew and accordingly can be transferred onto a margin of the printing medium 36 correctly. As a result, it can eliminate a blank or an incomplete image on the margin of the printing medium 36, so as to enhance quality of the image printed by the thermal sublimation printer 30.

Figure 3:
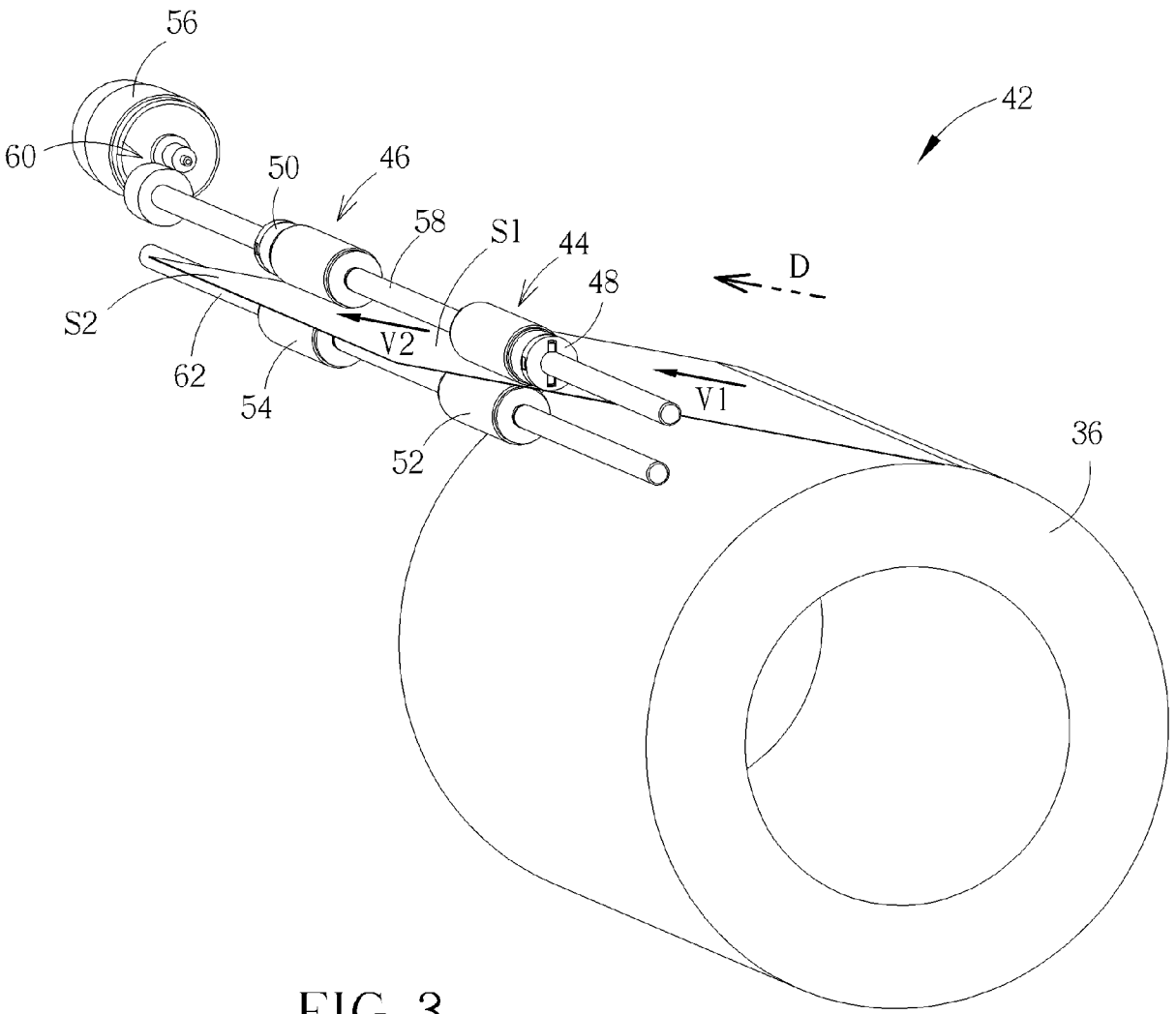
FIG. 3 is a diagram of a de-skewing mechanism and a printing medium according to the preferred embodiment of the present invention.

Please refer to FIG. 3. FIG. 3 is a diagram of the de-skewing mechanism 42 and the printing medium 36 according to the preferred embodiment of the present invention. As shown in FIG. 3, the de-skewing mechanism 42 includes a first calibrating roller 44, a second calibrating roller 46, a first torque limiting member 48, a second torque limiting member 50, a first idle roller 52 and a second idle roller 54. The first idle roller 52 and the second idle roller 54 respectively correspond to the first calibrating roller 44 and the second calibrating roller 46. The first idle roller 52 and the second idle roller 54 are disposed on sides corresponding to the first calibrating roller 44 and the second calibrating roller 46, respectively. The first idle roller 52 is used for holding a first side S1 of the printing medium 36 cooperatively with the first calibrating roller 44, so as to cooperatively convey the first side S1 of the printing medium 36. The second idle roller 54 is used for holding a second side S2 of the printing medium 36 cooperatively with the second calibrating roller 46, so as to cooperatively convey the second side S2 of the printing medium 36. Furthermore, the de-skewing mechanism 42 further includes an actuator 56, a transmission shaft 58 and a gear transmission assembly 60. The actuator 56 is used for generating a torque for further driving the gear transmission assembly 60. In this embodiment, the actuator 56 can be, but not limited to, a DC motor. For example, the actuator 56 can be a stepping motor as well. In other words, electrical motors capable of generating the torque are within the scope of the present invention.

Figure 4:
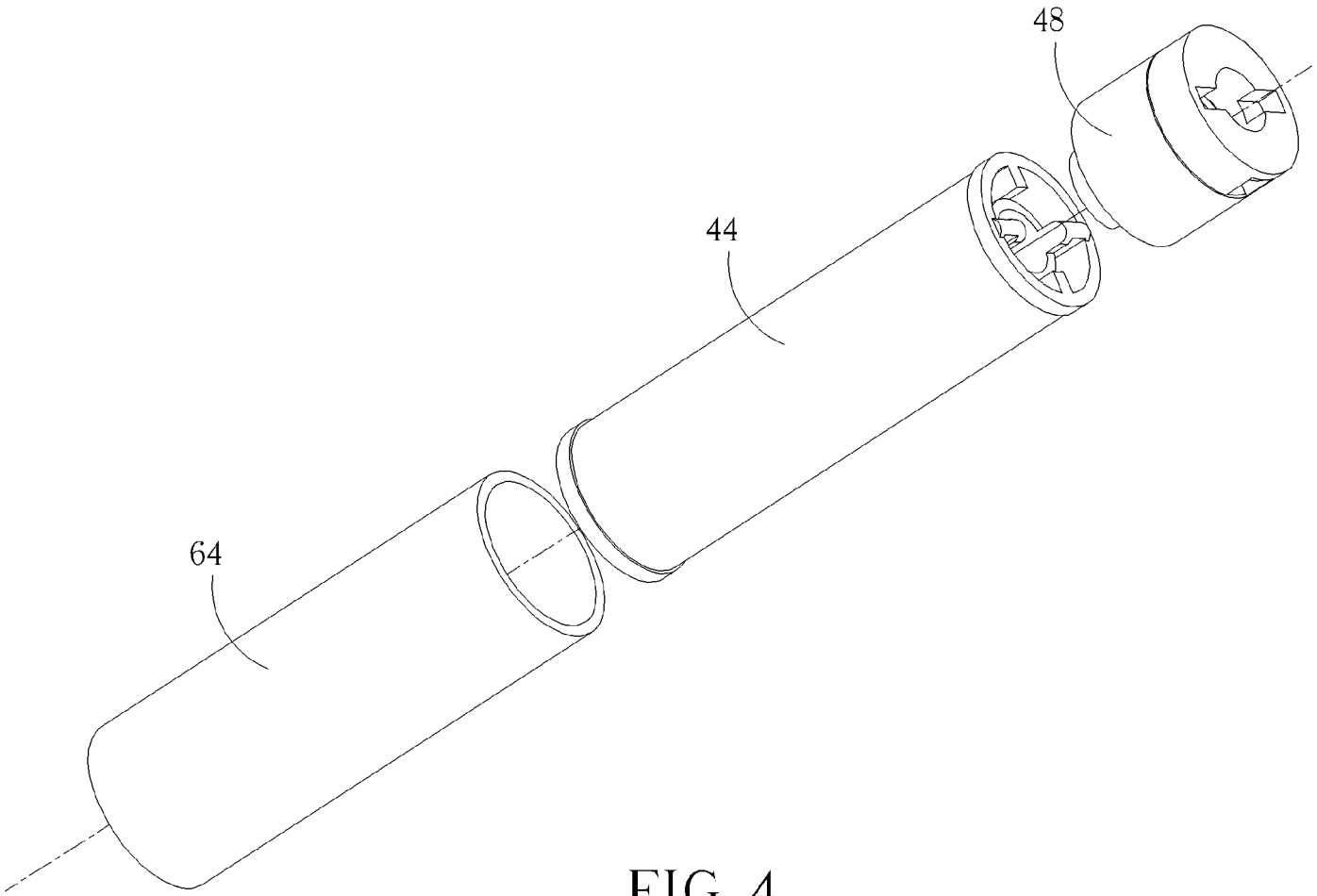
FIG. 4 is an exploded diagram of a first calibrating roller and a second calibrating roller according to the preferred embodiment of the present invention.

Furthermore, the gear transmission assembly 60 is respectively engaged with the actuator 56 and the transmission shaft 58. Accordingly, the gear transmission assembly 60 can be used for transmitting the torque generated by the actuator 56 to the transmission shaft 58, so as to drive the transmission shaft 58. In addition, the transmission shaft 58 is connected to the first torque limiting member 48 and the second torque limiting member 50, so as to transmit the torque transmitted from the gear transmission assembly 60 to the first torque limiting member 48 and the second torque limiting member 50. Please refer to FIG. 4. FIG. 4 is an exploded diagram of the first calibrating roller 44 and the second calibrating roller 46 according to the preferred embodiment of the present invention. As shown in FIG. 4, the first torque limiting member 48 is coupled to an end of the first calibrating roller 44. In this embodiment, when an internal resistance between the first torque limiting member 48 and the first calibrating roller 44 is smaller than a predetermined value, the first torque limiting member 48 can overcome the internal resistance, so as to transmit the torque transmitted from the transmission shaft 58 to the first calibrating roller 44. In the meanwhile, the first calibrating roller 44 can be driven by the actuator 56 of the de-skewing mechanism 42, so as to drive the first side S1 of the printing medium 36 to proceed in the conveying direction D. On the other hand, when the internal resistance between the first torque limiting member 48 and the first calibrating roller 44 is greater than the predetermined value, the first torque limiting member 48 cannot overcome the internal resistance. In other words, the first torque limiting member 48 cannot transmit the torque transmitted from the transmission shaft 58 to the first calibrating roller 44. In such a manner, the first calibrating roller 44 can not be driven by the actuator 56 of the de-skewing mechanism 42. As a result, the first side S1 of the printing medium 36 is conveyed by the conveying mechanism 38, such that the first side S1 of the printing medium 36 is capable of proceeding in the first linear velocity V1 acted in the conveying direction D.

Figure 5:
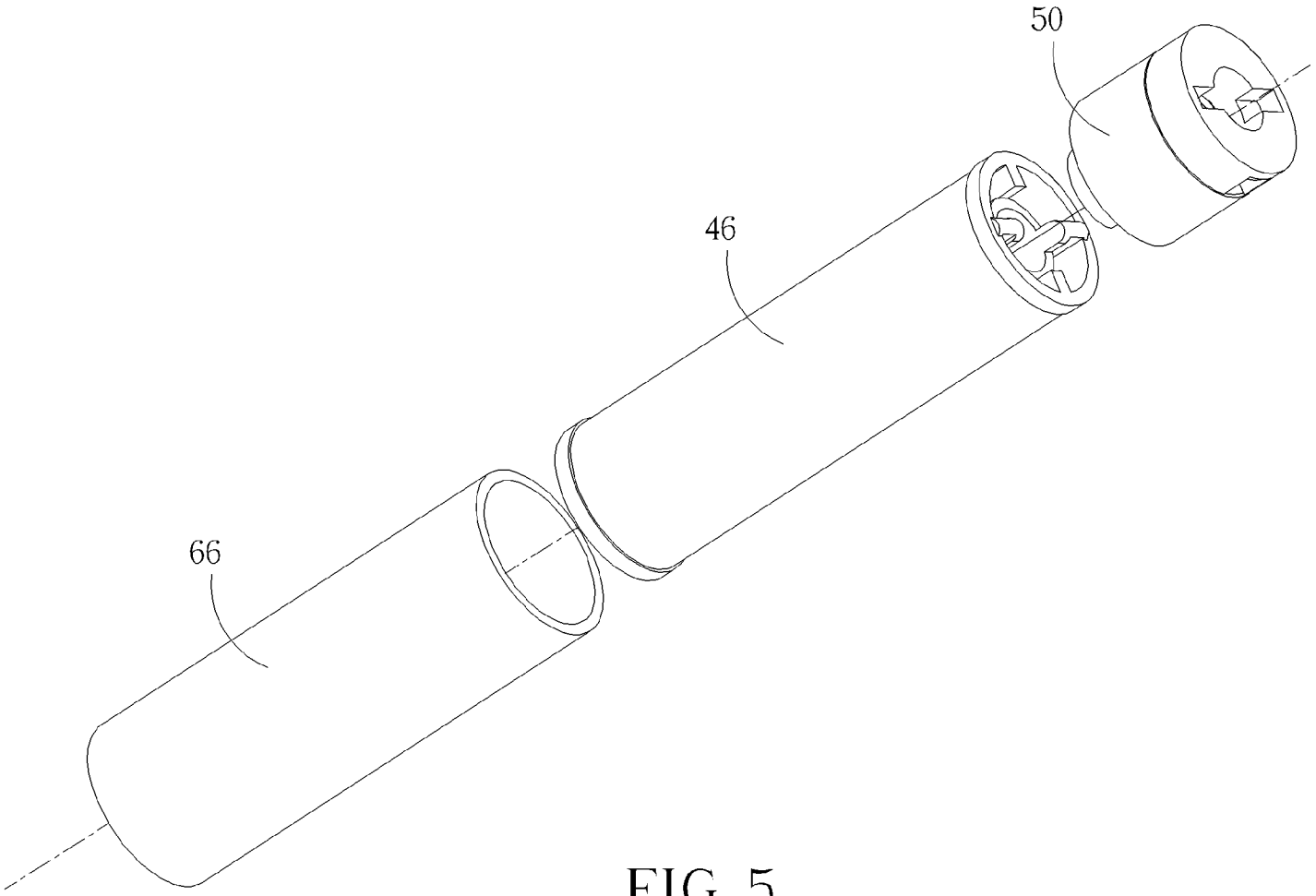
FIG. 5 is an exploded diagram of the second calibrating roller 46 and a second torque limiting member according to the preferred embodiment of the present invention.

Please refer to FIG. 5. FIG. 5 is an exploded diagram of the second calibrating roller 46 and the second torque limiting member 50 according to the preferred embodiment of the present invention. As shown in FIG. 5, the second torque limiting member 50 is coupled to an end of the second calibrating roller 46. Similarly, when the internal resistance between the second torque limiting member 50 and the second calibrating roller 46 is smaller than the predetermined value, the second torque limiting member 50 can overcome the internal resistance, so as to transmit the torque transmitted from the transmission shaft 58 to the second calibrating roller 46. In the meanwhile, the second calibrating roller 46 can be driven by the actuator 56 of the de-skewing mechanism 42, so as to drive the second side S2 of the printing medium 36 to proceed in the conveying direction D. On the other hand, when the internal resistance between the second torque limiting member 50 and the second calibrating roller 46 is greater than the predetermined value, the second torque limiting member 50 can not overcome the internal resistance. In other words, the second torque limiting member 50 can not transmit the torque transmitted from the transmission shaft 58 to the second calibrating roller 46. In such a manner, the second calibrating roller 46 can not be driven by the actuator 56 of the de-skewing mechanism 42. As a result, the second side S2 of the printing medium 36 is conveyed by the conveying mechanism 38, such that the second side S2 of the printing medium 36 is capable of proceeding in the first linear velocity V1 acted in the conveying direction D.

It should be noticed that the first calibrating roller 44 can convey the first side S1 of the printing medium 36 in a second linear velocity V2 greater than the first linear velocity V1 and acted in the conveying direction D, and the second calibrating roller 46 can convey the second side S2 of the printing medium 36 in the second linear velocity V2 greater than the first linear velocity V1 and acted in the conveying direction D by design of a gear ratio of the gear transmission assembly 60 and the actuator 56 when the first side S1 of the printing medium 36 is driven by the first calibrating roller 44 and/or the second side S2 of the printing medium 36 is driven by the second calibrating roller 46. In addition, the de-skewing mechanism 42 further includes a shaft member 62 disposed through the first idle roller 52 and the second idle roller 54. Furthermore, the first idle roller 52 and the second idle roller 54 are capable of rolling relative to the shaft member 62, respectively. In such a manner, the first idle roller 52 and the second idle roller 54 can be respectively driven by the first calibrating roller 44 and the second calibrating roller 46, so as to hold the printing medium 36 cooperatively with the first calibrating roller 44 and the second calibrating roller 46. Accordingly, the printing medium 36 can be conveyed in the conveying direction D.

As shown in FIG. 4 and FIG. 5, the de-skewing mechanism 42 can further include a first cushion 64 and a second cushion 66. The first cushion 64 is wrapped around a surface of the first calibrating roller 44, and the second cushion 66 is wrapped around a surface of the second calibrating roller 46. The first cushion 64 is used for increasing friction between the first side S1 of the printing medium 36 and the first cushion 64, so as to prevent the first side S1 of the printing medium 36 from slipping as proceeding in the conveying direction D. Similarly, the second cushion 66 is used for increasing friction between the second side S2 of the printing medium 36 and the second cushion 66, so as to prevent the second side S2 of the printing medium 36 from slipping as proceeding in the conveying direction D. In such a manner, the de-skewing mechanism 42 can convey the printing medium 36 in the second linear velocity V2 more stably. In this embodiment, the first cushion 64 and the second cushion 66 can be made in rubber materials, respectively.

Figure 6:
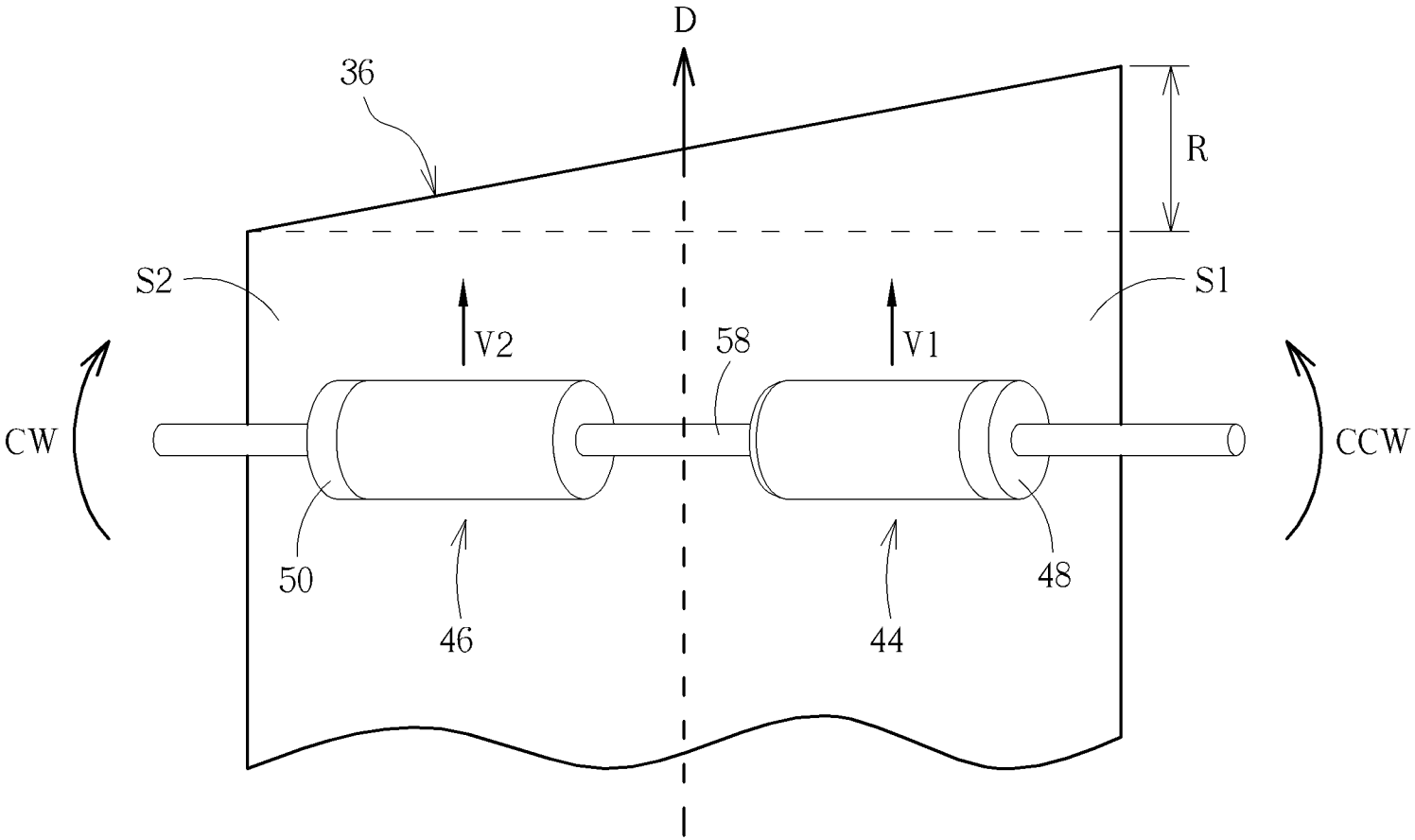
FIG. 6 is a diagram of a printing medium in a first skewing status according to the preferred embodiment of the present invention.

Please refer to FIG. 6. FIG. 6 is a diagram of the printing medium 36 in a first skewing status according to the preferred embodiment of the present invention. As shown in FIG. 6, the printing medium 36 skews in a counterclockwise direction CCW relative to the conveying direction D. In other words, a front edge of the first side S1 of the printing medium 36 leads a front edge of the second side S2 of the printing medium 36 in the conveying direction D with a distance R. In the meanwhile, the first side S1 of the printing medium 36 is in a stressed status with respect to the second side S2 of the printing medium 36. In other words, the first side S1 of the printing medium 36 reaches a predetermined tension, such that the predetermined tension causes the internal resistance between the first torque limiting member 48 and the first calibrating roller 44 to be greater than the predetermined value. Accordingly, when the first calibrating roller 44 is desired to drive the first side S1 of the printing medium 36 to proceed in the second linear velocity V2 acted in the conveying direction D, the first torque limiting member 48 stops driving the first calibrating roller 44, such that the first calibrating roller 44 is incapable of driving the first side S1 of the printing medium 36 since the first torque limiting member 48 can not overcome the internal resistance. In the meanwhile, the first side S1 of the printing medium 36 continues to be driven by the conveying mechanism 38, that is, the first side S1 of the printing medium 36 continues to proceed in the first linear velocity V1 acted in the conveying direction D.

Furthermore, the second side S2 of the printing medium 36 is in a released status with respect to the first side S1 of the printing medium 36. In other words, the second side S2 of the printing medium 36 does not reach the predetermined tension. In the meanwhile, the internal resistance between the second torque limiting member 50 and the second calibrating roller 46 is smaller than the predetermined value, such that the second torque limiting member 50 is capable of overcoming the internal resistance. Accordingly, the second torque limiting member 50 and the second calibrating roller 46 can drive the second side S2 of the printing medium 36 to proceed in the second linear velocity V2 acted in the conveying direction D. In the meanwhile, since the second side S2 of the printing medium 36 is conveyed faster than the first side S1 of the printing medium 36 in the conveying direction D, the second side S2 of the printing medium 36 can proceed relative to the first side S1 of the printing medium 36 in the conveying direction D, so as to catch up with the first side S1. In such a manner, the printing medium 36 can be skewed in a clockwise direction CW relative to the conveying direction D, until the front edge of the second side S2 catches up the front edge of the first side S1 of the printing medium 36 after proceeding in the distance R. Accordingly, the second side S2 of the printing medium 36 can be aligned with the first side S1 of the printing medium 36.

When the second side S2 of the printing medium 36 is aligned with the first side S1 of the printing medium 36, the second side S2 of the printing medium 36 reaches the predetermined tension. In the meanwhile, the predetermined tension causes the internal resistance between the second torque limiting member 50 and the second calibrating roller 46 to be greater than the aforesaid predetermined value. As a result, when the second calibrating roller 46 is desired to drive the second side S2 of the printing medium 36 to proceed in the second linear velocity V2 acted in the conveying direction D, the second torque limiting member 50 stops driving the second calibrating roller 46, such that the second calibrating roller 46 is incapable of driving the second side S2 of the printing medium 36 since the second torque limiting member 50 can not overcome the internal resistance. In the meanwhile, the second side S2 of the printing medium 36 is reconveyed by the conveying mechanism 38. In other words, the second side S2 of the printing medium 36 recovers to proceed in the first linear velocity V1 acted in the conveying direction D. In the meanwhile, there is no velocity difference between the second side S2 of the printing medium 36 and the first side S1 of the printing medium 36, such that both of the second side S2 and the first side S1 proceed in the first linear velocity V1 acted in the conveying direction D.

Figure 7:
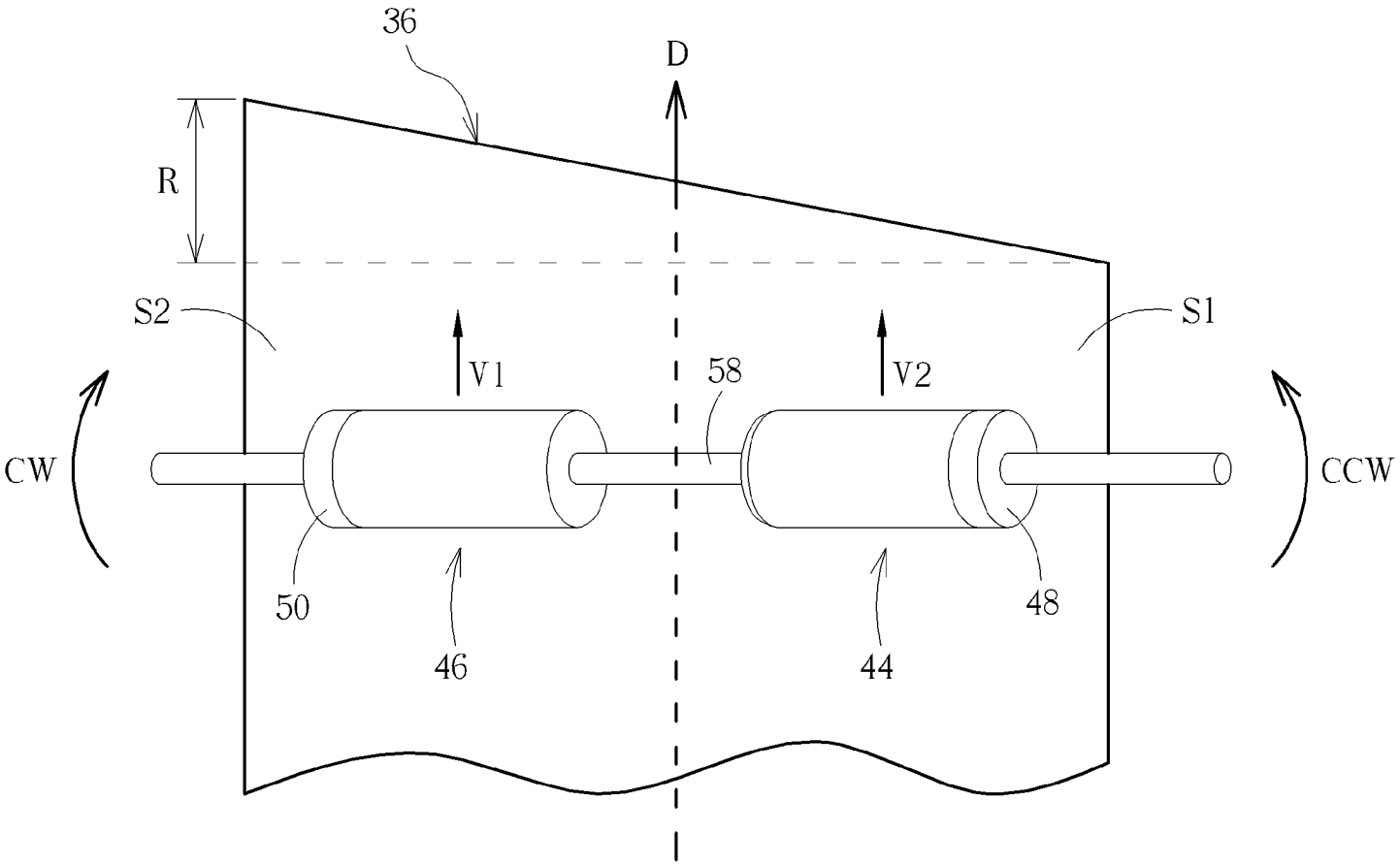
FIG. 7 is a diagram of the printing medium in a second skewing status according to the preferred embodiment of the present invention.

Please refer to FIG. 7. FIG. 7 is a diagram of the printing medium 36 in a second skewing status according to the preferred embodiment of the present invention. As shown in FIG. 7, the printing medium 36 skews in a clockwise direction CW relative to the conveying direction D. In other words, the front edge of the second side S2 of the printing medium 36 leads the front edge of the first side S1 of the printing medium 36 in the conveying direction D with the distance R. In the meanwhile, the second side S2 of the printing medium 36 is in a stressed status with respect to the first side S1 of the printing medium 36. In other words, the second side S2 of the printing medium 36 reaches the predetermined tension, such that the predetermined tension causes the internal resistance between the second torque limiting member 50 and the second calibrating roller 46 to be greater than the predetermined value. Accordingly, when the second calibrating roller 46 is desired to drive the second side S2 of the printing medium 36 to proceed in the second linear velocity V2 acted in the conveying direction D, the second torque limiting member 50 stops driving the second calibrating roller 46, such that the second calibrating roller 46 is incapable of driving the second side S2 of the printing medium 36 since the second torque limiting member 50 can not overcome the internal resistance. In the meanwhile, the second side S2 of the printing medium 36 continues to be driven by the conveying mechanism 38, that is, the second side S2 of the printing medium 36 continues to proceed in the first linear velocity V1 acted in the conveying direction D.

Furthermore, the first side S1 of the printing medium 36 is in a released status with respect to the second side S2 of the printing medium 36. In other words, the first side S1 of the printing medium 36 does not reach the predetermined tension. In the meanwhile, the internal resistance between the first torque limiting member 48 and the first calibrating roller 44 is smaller than the predetermined value, such that the first torque limiting member 48 is capable of overcoming the internal resistance. Accordingly, the first torque limiting member 48 and the first calibrating roller 44 can drive the first side S1 of the printing medium 36 to proceed in the second linear velocity V2 acted in the conveying direction D. In the meanwhile, since the first side S1 of the printing medium 36 is conveyed faster than the second side S2 of the printing medium 36 in the conveying direction D, the first side S1 of the printing medium 36 can proceed relative to the second side S2 of the printing medium 36 in the conveying direction D, so as to catch up with the second side S2. In such a manner, the printing medium 36 can be skewed in the counterclockwise direction CCW relative to the conveying direction D, until the front edge of the first side S1 catches up the front edge of the second side S2 of the printing medium 36 after proceeding in the distance R. Accordingly, the first side S1 of the printing medium 36 can be aligned with the second side S2 of the printing medium 36.

When the first side S1 of the printing medium 36 is aligned with the second side S2 of the printing medium 36, the first side S1 of the printing medium 36 reaches the predetermined tension. In the meanwhile, the predetermined tension causes the internal resistance between the first torque limiting member 48 and the first calibrating roller 44 to be greater than the aforesaid predetermined value. As a result, when the first calibrating roller 44 is desired to drive the first side S1 of the printing medium 36 to proceed in the second linear velocity V2 acted in the conveying direction D, the first torque limiting member 48 stops driving the first calibrating roller 44, such that the first calibrating roller 44 is incapable of driving the first side S1 of the printing medium 36 since the first torque limiting member 48 can not overcome the internal resistance. In the meanwhile, the first side S1 of the printing medium 36 is re-conveyed by the conveying mechanism 38. In other words, the first side S1 of the printing medium 36 recovers to proceed in the first linear velocity V1 acted in the conveying direction D. In the meanwhile, there is no velocity difference between the second side S2 of the printing medium 36 and the first side S1 of the printing medium 36, such that both of the second side S2 and the first side S1 proceed in the first linear velocity V1 acted in the conveying direction D.

Compared to the prior art, the present invention utilizes the torque limiting members cooperatively with the calibrating rollers to de-skew the two sides of the printing medium, so as to align the two sides of the printing medium during the thermal printing process. When one of the two sides of the printing medium reaches the predetermined tension, the torque limiting member can not transmit a torque to the calibrating roller, so as to stop driving the calibrating roller. In other words, the side of the printing medium is conveyed by the conveying mechanism and proceeds in the first linear velocity. In the meanwhile, the other side of the printing medium continues to be conveyed by the calibrating roller driven by the torque limiting member. In other words, the other side of the printing medium is conveyed by the calibrating roller and proceeds in the second linear velocity. Since the second linear velocity can be designed to be greater than the first linear velocity, the other side of the printing medium driven by the calibrating roller can proceed relative to the side of the printing medium conveyed by the conveying mechanism at a differential velocity between the first linear velocity and the second linear velocity. In such a manner, the de-skewing mechanism of the present invention can de-skew two sides of a front edge of the printing medium when the printing medium is conveyed, so as to eliminate a blank or an incomplete image on the margin of the printing medium. As a result, it enhances quality of printed images and advantages of products in the market.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A de-skewing mechanism for de-skewing a printing medium, the printing medium being conveyed by a conveying mechanism in a first linear velocity, the de-skewing mechanism comprising:

a first calibrating roller for conveying a first side of the printing medium in a second linear velocity greater than the first linear velocity;

a second calibrating roller for conveying a second side of the printing medium in the second linear velocity;

a first torque limiting member coupled to the first calibrating roller for stopping driving the first calibrating roller when the first side of the printing medium reaches a predetermined tension, such that the second side of the printing medium is capable of proceeding relative to the first side, so as to be aligned with the first side; and a second torque limiting member coupled to the second calibrating roller for stopping driving the second calibrating roller when the second side of the printing medium reaches the predetermined tension, such that the first side of the printing medium is capable of proceeding relative to the second side, so as to be aligned with the second side.

2. The de-skewing mechanism of claim 1, further comprising:

an actuator;

a transmission shaft for transmitting a torque to the first torque limiting member and the second torque limiting member; and a gear transmission assembly engaged with the actuator and the transmission shaft for transmitting the torque generated by the actuator to the transmission shaft.

3. The de-skewing mechanism of claim 1, further comprising:

a first idle roller for conveying the first side of the printing medium cooperatively with the first calibrating roller; and a second idle roller for conveying the second side of the printing medium cooperatively with the second calibrating roller.

4. The de-skewing mechanism of claim 3, further comprising:

a shaft member disposed through the first idle roller and the second idle roller, and the first idle roller and the second idle roller being capable of rolling relative to the shaft member, respectively.

5. The de-skewing mechanism of claim 1, further comprising a first cushion and a second cushion, the first cushion being wrapped around a surface of the first calibrating roller, and the second cushion being wrapped around a surface of the second calibrating roller.

6. The de-skewing mechanism of claim 5, wherein the first cushion and the second cushion are respectively made in rubber materials.

7. A thermal sublimation printer, comprising:

a conveying mechanism for conveying a printing medium in a first linear velocity; and a de-skewing mechanism for de-skewing the printing medium conveyed by the conveying mechanism, the de-skewing mechanism comprising:

a first calibrating roller for conveying a first side of the printing medium in a second linear velocity greater than the first linear velocity;

a second calibrating roller for conveying a second side of the printing medium in the second linear velocity;

a first torque limiting member coupled to the first calibrating roller for stopping driving the first calibrating roller when the first side of the printing medium reaches a predetermined tension, such that the second side of the printing medium is capable of proceeding relative to the first side, so as to be aligned with the first side; and a second torque limiting member coupled to the second calibrating roller for stopping driving the second calibrating roller when the second side of the printing medium reaches the predetermined tension, such that the first side of the printing medium is capable of proceeding relative to the second side, so as to be aligned with the second side.

8. The thermal sublimation printer of claim 7, wherein the de-skewing mechanism further comprises:

an actuator;

a transmission shaft for transmitting a torque to the first torque limiting member and the second torque limiting member; and a gear transmission assembly engaged with the actuator and the transmission shaft for transmitting the torque generated by the actuator to the transmission shaft.

9. The thermal sublimation printer of claim 7, wherein the de-skewing mechanism further comprises:

a first idle roller for conveying the first side of the printing medium cooperatively with the first calibrating roller; and a second idle roller for conveying the second side of the printing medium cooperatively with the second calibrating roller.

10. The thermal sublimation printer of claim 9, wherein the de-skewing mechanism further comprises:

a shaft member disposed through the first idle roller and the second idle roller, and the first idle roller and the second idle roller being capable of rolling relative to the shaft member, respectively.

11. The thermal sublimation printer of claim 7, wherein the de-skewing mechanism further comprises a first cushion and a second cushion, the first cushion is wrapped around a surface of the first calibrating roller, and the second cushion is wrapped around a surface of the second calibrating roller.

12. The thermal sublimation printer of claim 11, wherein the first cushion and the second cushion are respectively made in rubber materials.

* * * * *